US010707615B2

(12) United States Patent
Yamane et al.

(10) Patent No.: US 10,707,615 B2
(45) Date of Patent: Jul. 7, 2020

(54) ELECTRICAL CONNECTOR

(71) Applicant: Tyco Electronics Japan G.K., Kawasaki-shi (JP)

(72) Inventors: Tomokazu Yamane, Kawasaki (JP); Seiji Komatsu, Kawasaki (JP)

(73) Assignee: Tyco Electronics Japan G.K., Kasawaski-Shi (JP)

( * ) Notice: Subject to any disclaimer, the term of this patent is extended or adjusted under 35 U.S.C. 154(b) by 0 days.

(21) Appl. No.: 16/453,275

(22) Filed: Jun. 26, 2019

(65) Prior Publication Data

US 2019/0393650 A1 Dec. 26, 2019

(30) Foreign Application Priority Data

Jun. 26, 2018 (JP) ..... 2018-120332

(51) Int. Cl.
*H01R 13/629* (2006.01)
*H01R 13/703* (2006.01)

(52) U.S. Cl.
CPC ..... *H01R 13/62938* (2013.01); *H01R 13/703* (2013.01)

(58) Field of Classification Search
CPC ..... H01R 13/193; H01R 13/703; H01R 13/62938
USPC ..... 439/266–268
See application file for complete search history.

(56) References Cited

U.S. PATENT DOCUMENTS 4,275,944 A * 6/1981 Sochor ..... H01R 12/89 439/267
4,303,294 A * 12/1981 Hamsher, Jr. ..... H01R 12/88 439/267
4,468,073 A * 8/1984 Machcinski ..... H01R 12/88 439/266
4,553,803 A * 11/1985 Lapraik ..... H01R 12/88 439/260
4,606,594 A * 8/1986 Grabbe ..... H01R 12/88 439/260
5,411,406 A * 5/1995 Kondo ..... H01R 13/113 439/259
8,641,438 B2 * 2/2014 Kamiya ..... H01R 12/721 439/260

(Continued)

FOREIGN PATENT DOCUMENTS

JP 2017-91805 A 5/2017

*Primary Examiner* — Gary F Paumen
(74) *Attorney, Agent, or Firm* — Barley Snyder

(57) ABSTRACT

An electrical connector comprises a first housing, a mating terminal retained in the first housing, a second housing mated with the first housing, a contact member disposed in the second housing, and an insertion/extraction assist protrusion. The contact member is electrically connected with the mating terminal by pinching the mating terminal with a plurality of spring pieces facing each other. The spring pieces each have a contact portion protruding inward. The insertion/extraction assist protrusion is adapted to expand a gap between the spring pieces when the first housing and the second housing move relative to one another in a mating direction. The insertion/extraction assist protrusion is arranged offset from the contact portions in a plane crossing the mating direction and is arranged nearer to a start point of the mating than the contact portions during the mating in the mating direction.

12 Claims, 12 Drawing Sheets

(56) References Cited

U.S. PATENT DOCUMENTS

| | | | | |
|---|---|---|---|---|
| 9,853,385 | B1 * | 12/2017 | Crofoot | H01R 13/193 |
| 10,389,052 | B2 * | 8/2019 | Tatzel | H01R 13/193 |
| 2008/0139026 | A1 * | 6/2008 | Sabo | H01R 12/57<br>439/267 |

* cited by examiner

ELECTRICAL CONNECTOR

CROSS-REFERENCE TO RELATED APPLICATIONS

This application claims the benefit of the filing date under 35 U.S.C. § 119(a)-(d) of Japanese Patent Application No. 2018-120332, filed on Jun. 26, 2018.

FIELD OF THE INVENTION

The present invention relates to an electrical connector and, more particularly, to an electrical connector having a contact electrically connected with a mating terminal.

BACKGROUND

Electrical connectors are known which are configured to pinch a flat terminal with a clip contact. Japanese Patent Application No. JP 2017-091805A discloses a configuration in which a contact avoiding portion is provided in one housing. The contact avoiding portion is adapted to expand an open width of the clip contact in order to prevent a mating terminal from being damaged from contact with the clip contact.

In JP 2017-091805A, when the mating terminal is inserted, the contact avoiding portion enters the clip contact to expand the open width of the contact. This allows the mating terminal to be inserted into the contact without making contact with the contact. Then, as a moving housing moves in the process of mating of the connector, the contact avoiding portion is extracted from the contact. Thereupon, the open width of the contact having the mating terminal inserted therein is narrowed, and thus the mating terminal makes contact with the contact.

In JP 2017-091805A, the clip contact makes contact with the mating terminal without sliding thereon during mating of the connector. Therefore, if an insulating substance has adhered to the mating terminal, the interposition of the insulating substrate between the clip contact and the mating terminal may cause a contact failure.

SUMMARY

An electrical connector comprises a first housing, a mating terminal retained in the first housing, a second housing mated with the first housing, a contact member disposed in the second housing, and an insertion/extraction assist protrusion. The contact member is electrically connected with the mating terminal by pinching the mating terminal with a plurality of spring pieces facing each other. The spring pieces each have a contact portion protruding inward. The insertion/extraction assist protrusion is adapted to expand a gap between the spring pieces when the first housing and the second housing move relative to one another in a mating direction. The insertion/extraction assist protrusion is arranged offset from the contact portions in a plane crossing the mating direction and is arranged nearer to a start point of the mating than the contact portions during the mating in the mating direction.

BRIEF DESCRIPTION OF THE DRAWINGS

The invention will now be described by way of example with reference to the accompanying Figures, of which.

DETAILED DESCRIPTION OF THE EMBODIMENT(S)

Figure 1A:
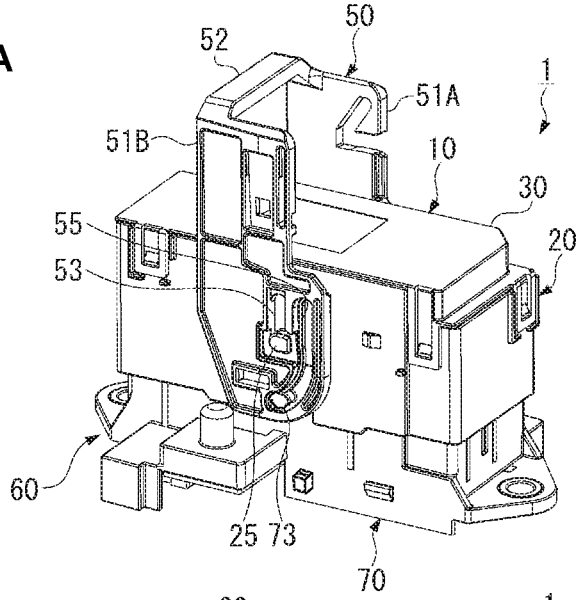
FIG. 1A is a perspective view of an electrical connector in an unmating position.

Embodiments of the present invention will be described hereinafter in detail with reference to the attached drawings, wherein like reference numerals refer to like elements. The present invention may, however, be embodied in many different forms and should not be construed as being limited to the embodiments set forth herein; rather, these embodiments are provided so that the disclosure will convey the concept of the invention to those skilled in the art.

A lengthwise direction X, a width direction Y, and a height direction Z in each element of the present embodiment are defined as shown in the drawings. In the present embodiment, an electrical connector 1 is positioned such that the height direction Z corresponds to a vertical direction and the lengthwise direction X and the width direction Y correspond to horizontal directions.

Figure 2A:
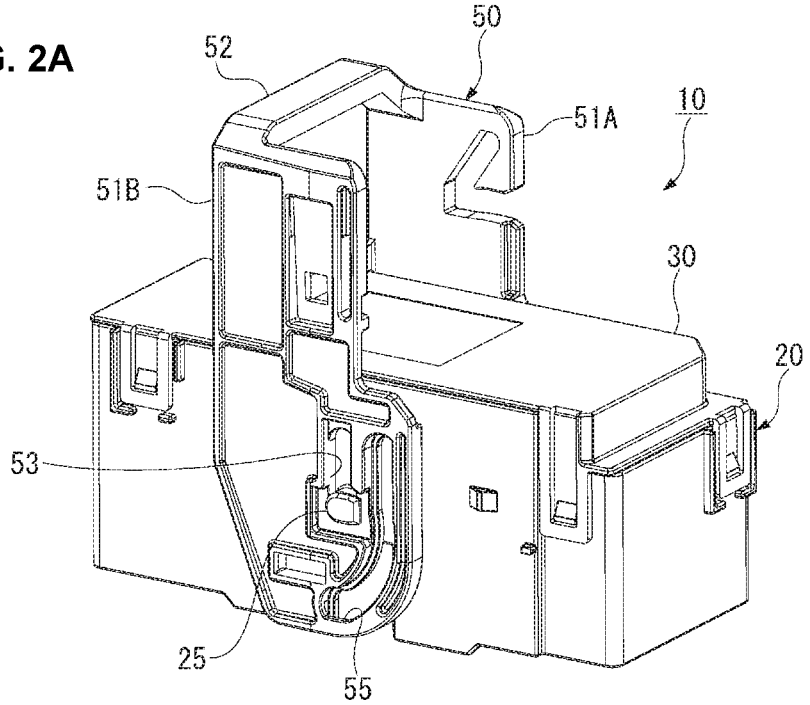
FIG. 2A is a perspective view of a lever assembly of the electrical connector.
Figure 2B:
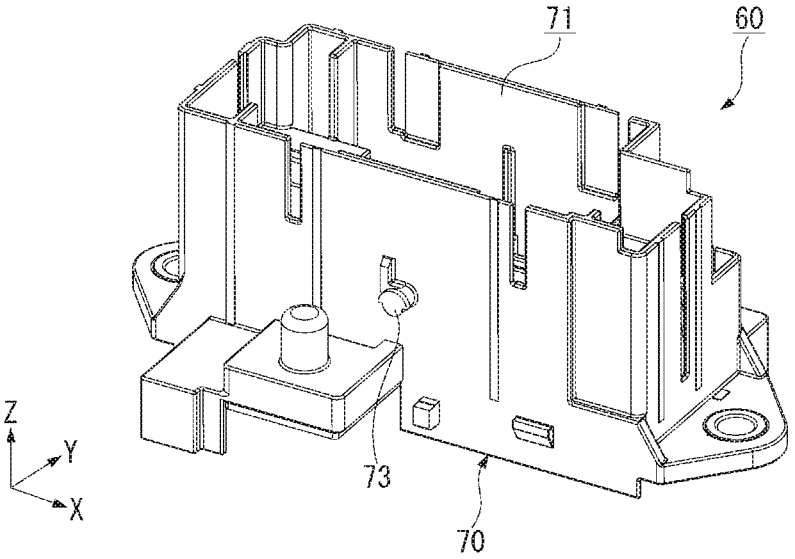
FIG. 2B is a perspective view of a cap assembly of the electrical connector.

The electrical connector 1 of the present embodiment replaceably accommodates a fuse member used in a highvoltage and high-current electric circuit. The electrical connector 1, as shown in FIGS. 2A and 2B, is provided with a lever assembly 10 and a cap assembly 60. The lever assembly 10 is so formed as to be capable of mating with the cap assembly 60.

Mating of the lever assembly 10 and the cap assembly 60 is performed in the following manner.

First of all, the lever assembly 10 and the cap assembly 60 are assembled together into a pre-mating state shown in FIG. 1A. Then, a lever 50 provided in the lever assembly 10 is pulled down to a position shown in FIG. 1B. Thereby, the lever assembly 10 and the cap assembly 60 are mated. Conversely, when the lever 50 is raised from the position in FIG. 1B to the position in FIG. 1A, the lever assembly 10 and the cap assembly 60 are unmated.

Figure 1B:
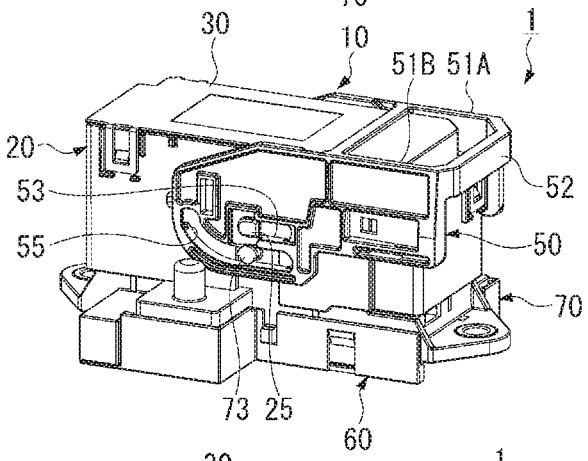
FIG. 1B is a perspective view of the electrical connector in a mating position.
Figure 1C:
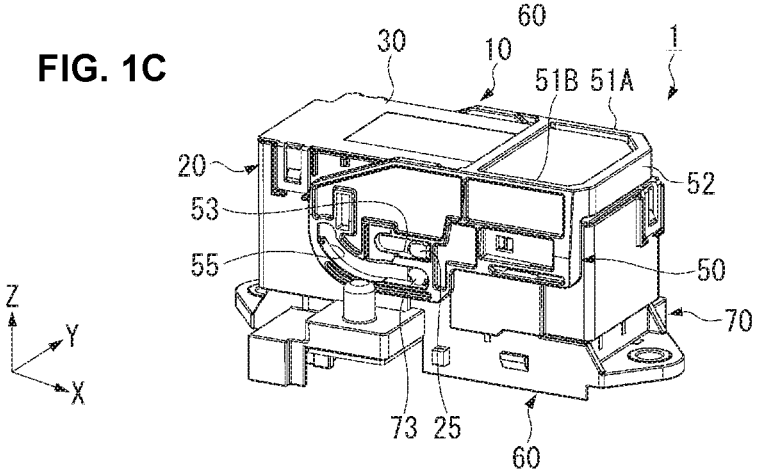
FIG. 1C is a perspective view of the electrical connector in a circuit actuation position.

In addition, when the lever 50 is slid horizontally from the mating position shown in FIG. 1B, the electrical connector 1 is shifted to a circuit actuation position shown in FIG. 1C. In the mating position, an interlock switch is off, and thus the electric circuit is shut off. On the other hand, in the circuit actuation position, the interlock switch is on, and thus the electric circuit is energized.

Figure 3:
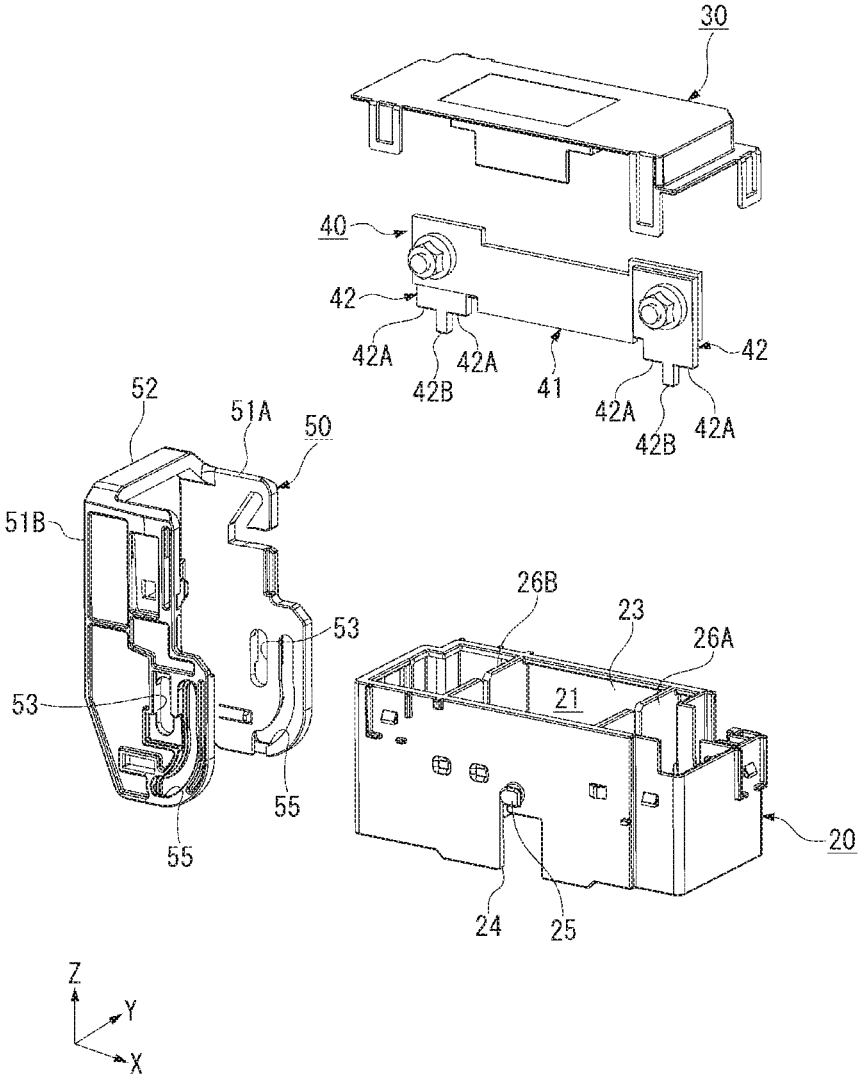
FIG. 3 is an exploded perspective view of the lever assembly.
Figure 4A:
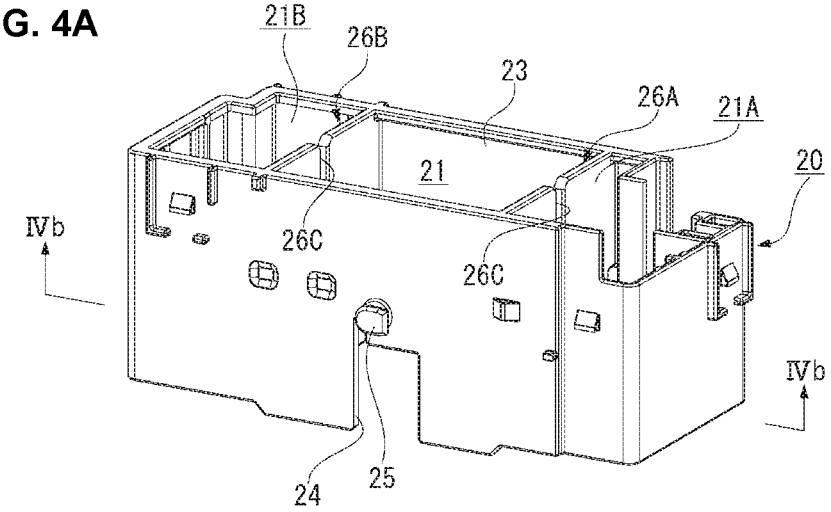
FIG. 4A is a perspective view of an outer housing of the lever assembly.
Figure 4B:
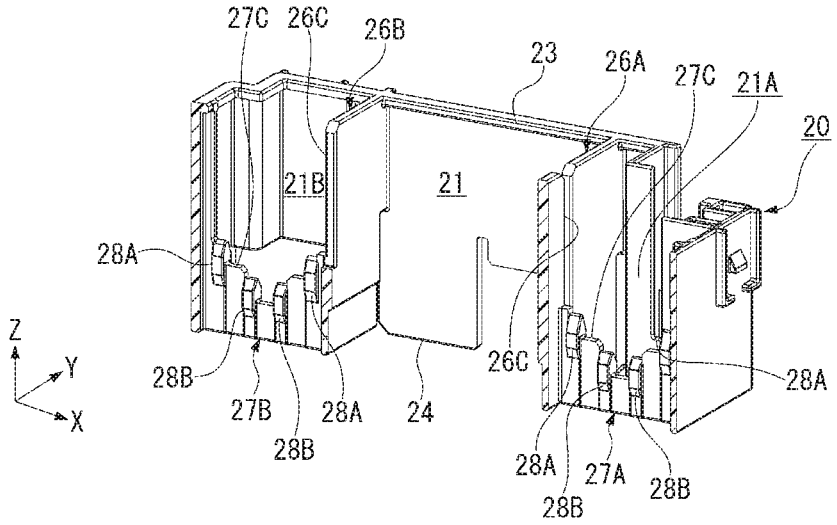
FIG. 4B is a sectional perspective view of the outer housing, taken along line IVb-IVb of FIG. 4A.

The lever assembly 10, as shown in FIGS. 2A and 3, is provided with an outer housing 20, a cover 30, a fuse member 40, and the lever 50. The outer housing 20 is an example of a first housing. The outer housing 20 is integrally formed by injection molding an insulating resin material. The cover 30 and the lever 50 are also formed in a similar manner to the outer housing 20.

The outer housing 20, as shown in FIG. 3, is open on both sides in the height direction Z (both upper and lower sides in FIG. 3), and is provided with a first accommodation chamber 21 between upper and lower openings 23, 24. The fuse member 40 to be connected to the electric circuit is accommodated in the first accommodation chamber 21. The cover 30 is attached to an upper face side of the outer housing 20 and, as shown in FIG. 2A, the upper opening 23 is covered with the cover 30. The outer housing 20 has an opening side on the lower opening 24 in the height direction Z.

When the lever assembly 10 and the cap assembly 60 are mated, the first accommodation chamber 21 overlaps with a second accommodation chamber 71 provided in the cap assembly 60. Therefore, in the mating state of the lever assembly 10 and the cap assembly 60, the fuse member 40 is accommodated in the first accommodation chamber 21 and the second accommodation chamber 71 overlapping internally and externally with each other.

Figure 5A:
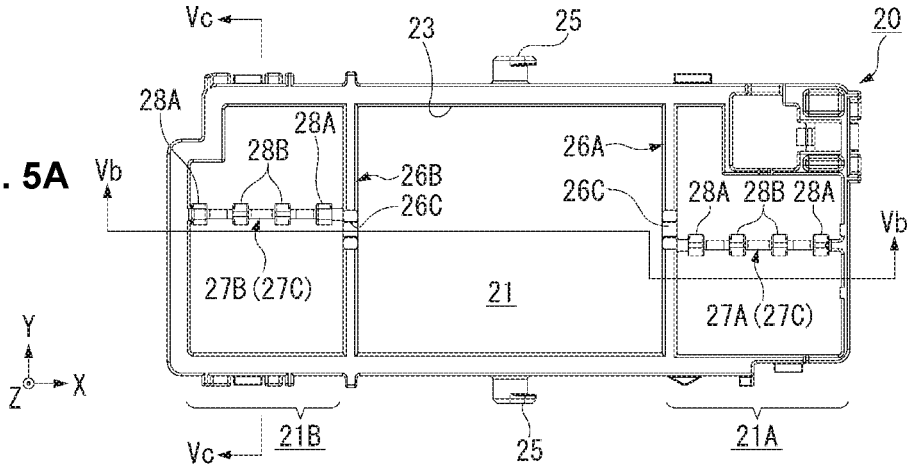
FIG. 5A is a plan view of the outer housing.

As shown in FIG. 5A, the outer housing 20 has a pair of pivot shafts 25, 25 on both sides in the width direction Y, on which lateral bodies 51A, 51B of the lever 50 are rotatably supported, respectively.

As shown in FIG. 5A, two first partition walls 26A, 26B extending in the width direction Y are provided in the first accommodation chamber 21 of the outer housing 20. A slit 26C for receiving a fusible body 41 is formed in each of the first partition walls 26A, 26B along the height direction Z.

Figure 6:
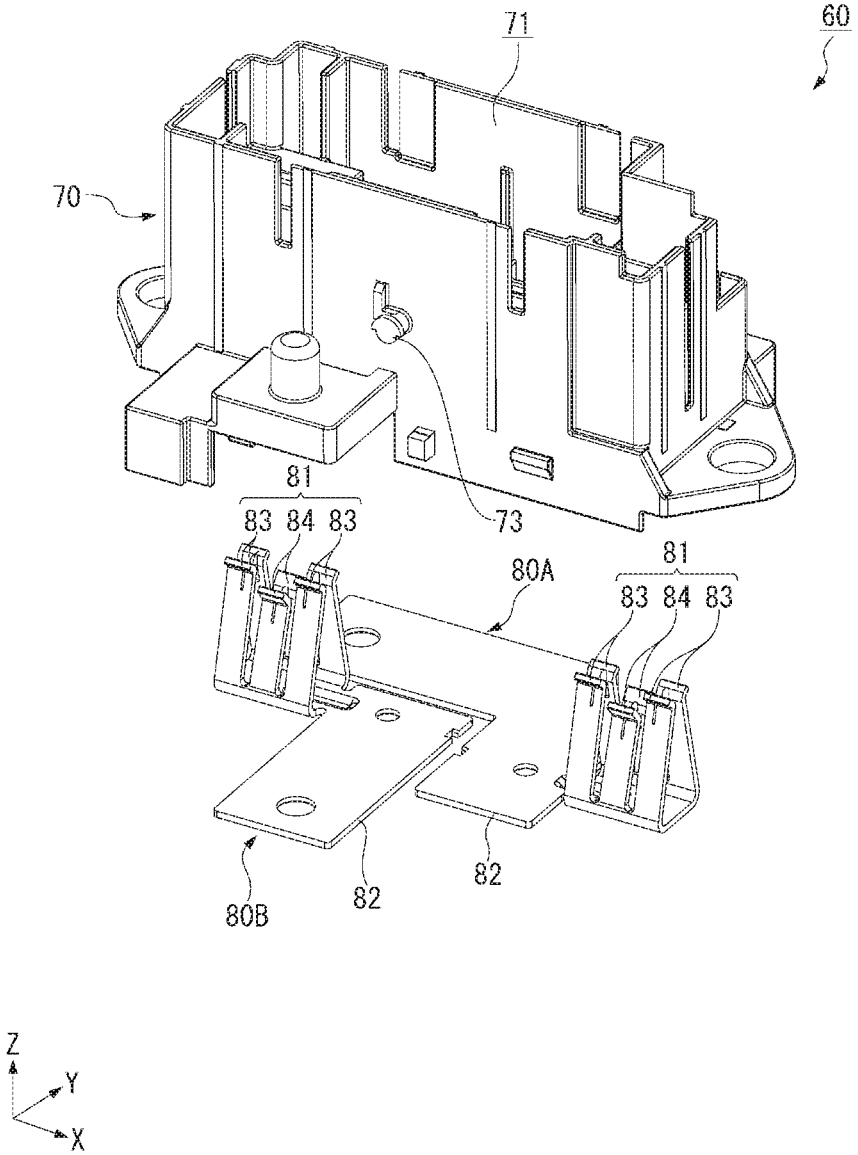
FIG. 6 is an exploded perspective view of the cap assembly.

In the first accommodation chamber 21, a fuse busbar 42 and a clip spring 80A, shown in FIG. 6, are accommodated in a space 21A at the right side in FIG. 5A partitioned with the first partition wall 26A. Similarly, in the first accommodation chamber 21, a fuse busbar 42 and a clip spring 80B, shown in FIG. 6, are accommodated in a space 21B at the left side in FIG. 5A partitioned with the first partition wall 26B.

As shown in FIG. 5A, a second partition wall 27A extending along the lengthwise direction X is provided in the space 21A partitioned with the first partition wall 26A. Similarly, as shown in FIG. 5A, a second partition wall 27B extending along the lengthwise direction X is provided in the space 21B partitioned with the first partition wall 26B. The second partition walls 27A, 27B are formed in positions in the width direction Y where the fuse busbars 42, 42 are arranged, respectively, and receive the fuse busbars 42, 42.

Figure 5B:
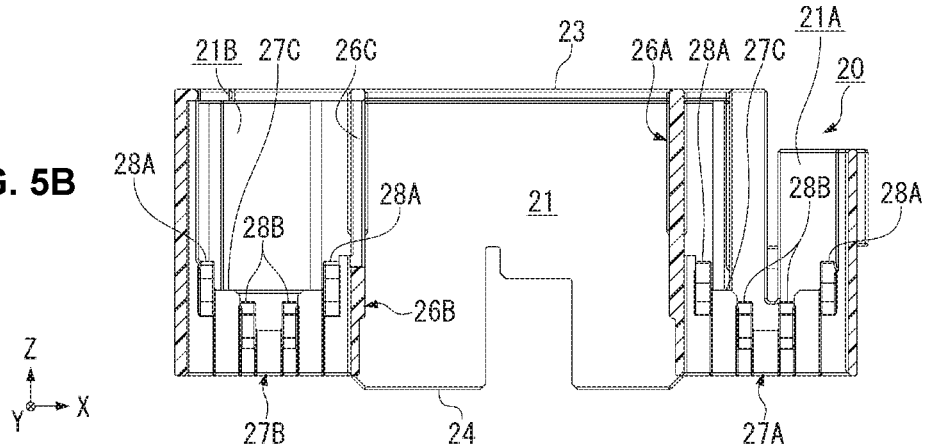
FIG. 5B is a sectional side view of the outer housing, taken along line Vb-Vb of FIG. 5A.

As shown in FIG. 5B, the second partition walls 27A, 27B are formed from the lower opening 24 of the outer housing 20 to a middle position in the outer housing 20 along the height direction Z. In addition, an upper portion in FIG. 5B of the second partition walls 27A, 27B has a stepped cutout portion 27C extending downward in a center thereof. The shape of this cutout portion 27C corresponds to the shape of the fuse busbar 42.

As shown in FIGS. 5A, 5B, four insertion/extraction assist protrusions 28A, 28B, 28B, 28A for expanding a support spring 81 are provided in the vicinity of the cutout portion 27C of the second partition walls 27A, 27B respectively. The insertion/extraction assist protrusions 28A, 28B, as shown in FIG. 5A, are formed on both faces of the second partition walls 27A, 27B respectively. In each of the second partition walls 27A, 27B, all intervals between the adjacent insertion/extraction assist protrusions 28A, 28B in the lengthwise direction X are equal to one another. In each of the second partition walls 27A, 27B, the middle two insertion/extraction assist protrusions 28B, 28B face both sides of the recessed portion of the cutout portion 27C.

Figure 5C:
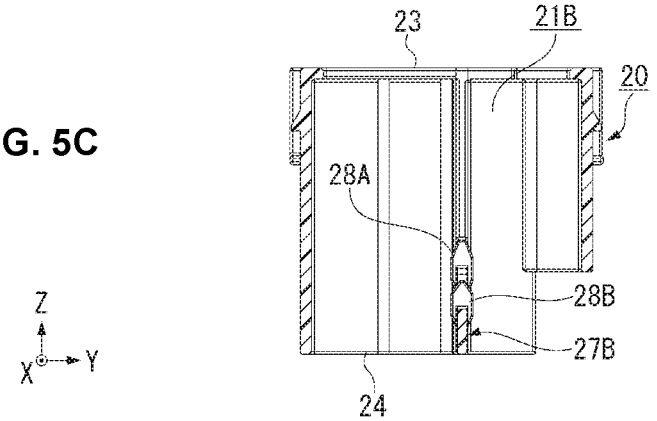
FIG. 5C is a sectional side view of the outer housing, taken along line Vc-Vc of FIG. 5A.

As shown in FIGS. 5B, 5C, the two central two insertion/extraction assist protrusions 28B are located in lower positions in FIGS. 5B, 5C in the height direction Z than the two insertion/extraction protrusions 28A located at both end portions. The positions in the height direction Z of the insertion/extraction assist protrusion 28A and the insertion/extraction assist protrusion 28B are so offset as to correspond to the positions in the height direction Z of a first contact portion 42A and a second contact portion 42B of the fuse busbar 42.

As shown in FIG. 5C, the insertion/extraction assist protrusions 28A, 28B each have a shape protruding in the width direction Y from a wall face of the second partition wall 27B and elongated in the height direction Z. Though FIG. 5C shows the insertion/extraction assist protrusions 28A, 28B of the second partition wall 27B, the configuration of the insertion/extraction assist protrusion of the second partition wall 27A is similar to that in FIG. 5C.

The fuse member 40 is configured to melt and break when excessive current flows therethrough, thereby protecting the electric circuit connected to the fuse member 40. The fuse member 40, as shown in FIG. 3, is provided with the flat fusible body 41, and the flat fuse busbars 42, 42 connected to both ends, respectively, of the fusible body 41. The fuse busbars 42, 42 are examples of a mating terminal. The respective shapes of the fuse busbars 42, 42 are the same, both of which are made by stamping a sheet material made of a conductive metal material, for example, a copper alloy, and thereafter plating it with a conductive metal such as gold or tin. One fuse busbar 42 is attached to a front face of the fusible body 41, whereas the other busbar 42 is attached to a back face of the fusible body 41. The two fuse busbars 42, 42 are attached in the same position in the height direction Z of the fusible body 41.

The fuse busbars 42, 42 are supported by the clip springs 80A, 80B at lower portions thereof shown in FIG. 3 in the mating state of the lever assembly 10 and the cap assembly 60. This makes the lower portions shown in FIG. 3 of the fuse busbar 42 function as contact portions to the clip springs 80A, 80B. The rectangular second contact portion 42B protruding downward in FIG. 3 is formed at a center of the contact portion of the fuse busbar 42. Furthermore, the first contact portion 42A located in a different position in the height direction Z from the second contact portion 42B is formed on both sides of the second contact portion 42B.

The lever 50 is a member to be operated with external force, and attached turnably and slidably to the outer housing 20. The lever 50 is configured to be capable of moving around the pivot shafts 25, 25 between the unmating position shown in FIG. 1A and the mating position shown in FIG. 1B. In addition, the lever 50 is configured to be capable of sliding horizontally between the mating position shown in FIG. 1B and the circuit actuation position shown in FIG. 1C.

The lever 50, as shown in FIG. 3, is provided with a pair of lateral bodies 51A, 51B extending parallel to each other and a coupling body 52 coupling the pair of lateral bodies 51A, 51B with each other. One end sides of the pair of lateral bodies 51A, 51B are supported turnably on the outer housing 20. The other ends of the pair of lateral bodies 51A, 51B are coupled together by the coupling body 52. Bearing holes 53, 53 into which the pivot shafts 25, 25 of the outer housing 20 are inserted are provided in the lateral bodies 51A, 51B, respectively. A cam groove 55 into which a cam protrusion 73 is inserted is formed in the lateral bodies 51A, 51B, respectively.

When the lever assembly 10 and the cap assembly 60 are mated, they are put into the mating position by turning the lever 50 from the unmating position to a horizontal orientation. In this action, the cam protrusion 73 moves in the cam groove 55, thereby mating the lever assembly 10 and the cap assembly 60 with each other.

The cap assembly 60, as shown in FIGS. 2B and 6, is provided with a cap housing 70 and the pair of clip springs 80A, 80B. The cap housing 70 is an example of a second housing. The cap housing 70 is integrally formed by injection molding an insulating resin material.

The cap housing 70, as shown in FIGS. 2B and 6, is provided with the second accommodation chamber 71 open in one side in the height direction Z (upper side in FIG. 6). A bottom floor is attached to the other side in the height direction Z (lower side in FIG. 6) of the cap housing 70. The clip springs 80A, 80B to be electrically connected with the fuse member 40 are accommodated in the second accommodation chamber 71.

When the lever assembly 10 and the cap assembly 60 are mated, the fuse busbars 42, 42 of the fuse member 40 are inserted into the support spring 81, 81 of the clip springs 80A, 80B, respectively. Thereby, the fuse member 40 and the clip springs 80A, 80B are electrically connected. At this time, the fuse member 40 and the clip springs 80A, 80B get accommodated in the first accommodation chamber 21 of the outer housing 20 and the second accommodation chamber 71 of the cap housing 70 overlapping with each other. The cam protrusions 73, 73 inserted into the cam grooves 55 of the lever 50 are formed in both sides in the width direction Y of the cap housing 70.

The clip springs 80A, 80B, as shown in FIG. 6, are contact members to be electrically connected with the fuse busbars 42 of the fuse member 40. The clip springs 80A, 80B are both made by stamping and then forming a sheet material made of a conductive and elastic metal material, for example, a copper alloy.

The clip springs 80A, 80B are each provided with the support spring 81 to be electrically connected to the fuse busbar 42 of the fuse member 40 and a flat support body 82 supporting the support spring 81. The support bodies 82, 82 of the clip springs 80A, 80B are each connected to a contact of the electric circuit. In addition, when the clip springs 80A, 80B are mounted to the cap housing 70, the support springs 81, 81 extend through the bottom floor into the second accommodation chamber 71.

The clip springs 80A, 80B have the same configuration except in that the shapes of the support bodies 82 are different. Therefore, in the following description, the configuration of the clip spring 80A will be described, whereas the description of the clip spring 80B will be omitted.

The support spring 81 of the clip spring 80A, as shown in FIG. 6 and FIGS. 7A, 7B, 7C, is composed of a combination of two pairs of tall first spring pieces 83, 83 and a pair of short second spring pieces 84, 84. Thus, the first spring piece 83 and the second spring piece 84 have different lengths in the lengthwise direction Z. The first spring pieces 83, 83 in each pair are provided opposite each other in the width direction Y. Similarly, the second spring pieces 84, 84 in each pair are both provided opposite each other in the width direction Y.

In the lengthwise direction X of the support spring 81, the second spring piece 84 is positioned between the first spring pieces 83, 83 with a slight gap. When the fuse busbar 42 is inserted into the support spring 81, the second spring piece 84 contacts with the second contact portion 42B of the fuse busbar 42. When the fuse busbar 42 is inserted into the support spring 81, the first spring pieces 83, 83 contacts with the first contact portions 42A, 42A, respectively, of the fuse busbar 42.

Figure 7A:
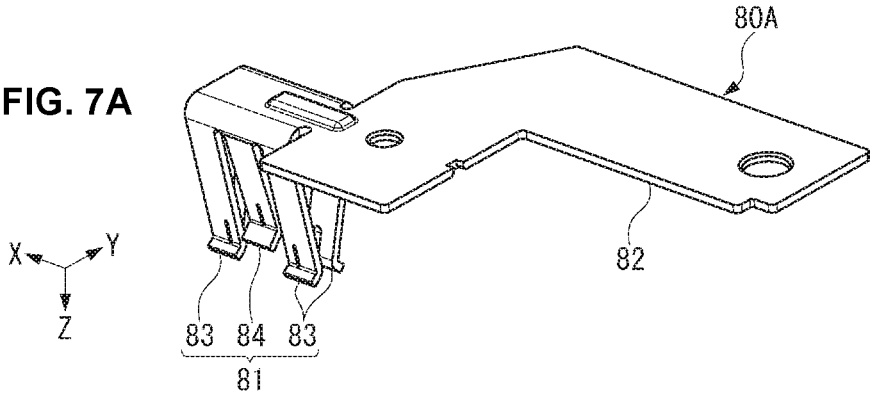
FIG. 7A is a bottom perspective view of a clip spring of the cap assembly.
Figure 7B:
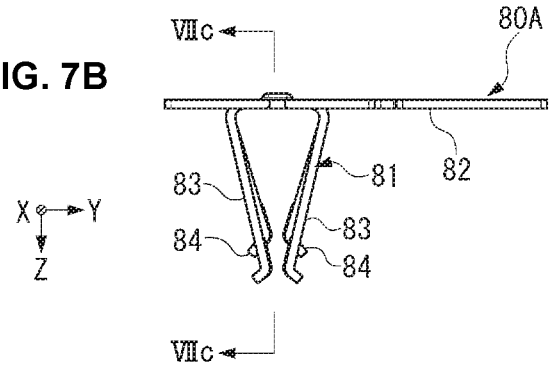
FIG. 7B is a side view of the clip spring.
Figure 7C:
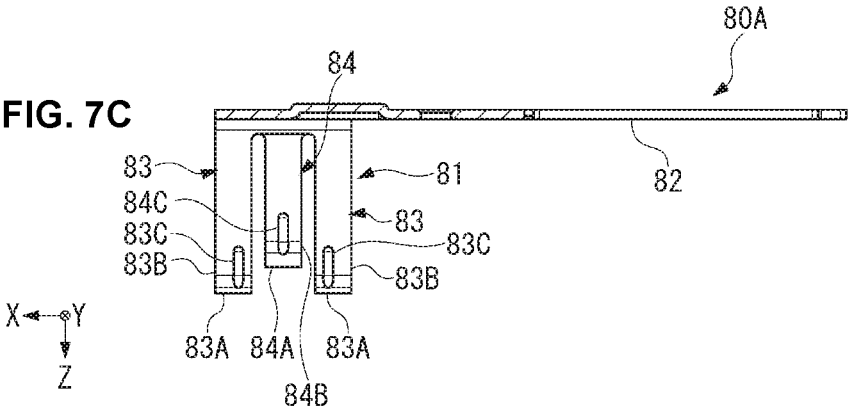
FIG. 7C is a sectional side view of the clip spring, taken along line VIIc-VIIc of FIG. 7B.

The first spring piece 83 and the second spring piece 84 have their respective tip portions 83A, 84A bent outward of the support spring 81. In addition, as shown in FIGS. 7C and 8, contact portions 83C, 84C protruding inward from the opposite spring pieces are formed in bent portions 83B, 84B, respectively, of the first spring piece 83 and the second spring piece 84.

The contact portion 83C, 84C extend along the height direction Z of the first spring piece 83 and the second spring piece 84, respectively. The contact portion 83C of the first spring piece 83 is positioned nearer to the second spring piece 84 rather than at a center of the first spring piece 83 in the lengthwise direction X. In addition, the contact portion 84C of the second spring piece 84 is positioned at a center of the second spring piece 84 in the lengthwise direction X. When the fuse busbar 42 is inserted into the support spring 81, the second partition walls 27A, 27B for receiving the fuse busbar 42 are inserted into the support spring 81 ahead of the fuse busbar 42.

Figure 8:
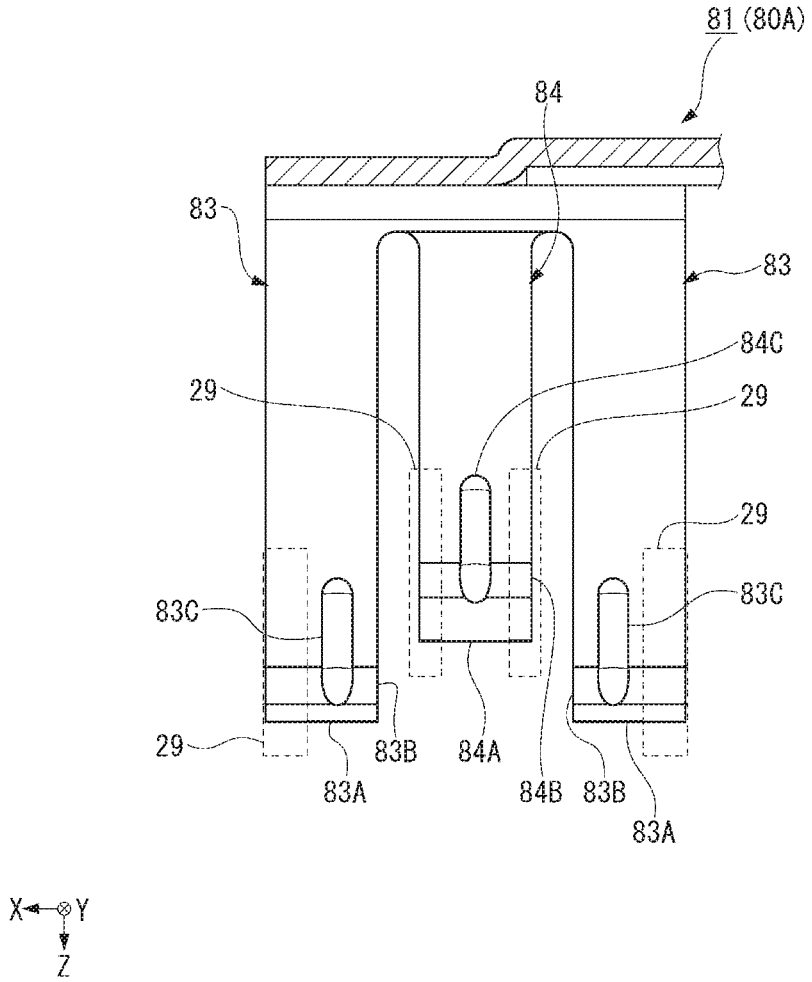
FIG. 8 is an enlarged sectional side view of a support spring portion of the clip spring.

In FIG. 8, ranges 29 in which the insertion/extraction assist protrusions 28A, 28B move when the electrical connector 1 is shifted from the unmating position to the mating position are each shown in a broken line. The contact portions 83C of the first spring pieces 83 on both sides are positioned between the insertion/extraction assist protrusions 28A, 28B in the lengthwise direction X. In addition, the contact portion 84C of the central second spring piece 84 is positioned between the insertion/extraction assist protrusions 28B, 28B in the lengthwise direction X. That is, the contact portions 83C, 84C are both arranged in positions offset from the insertion/extraction assist protrusions 28A, 28B in the lengthwise direction X.

When the second partition wall 27A is inserted into the support spring 81, the contact portions 83C of the two first spring pieces 83 both pass between the insertion/extraction assist protrusions 28A, 28B. In addition, when the second partition wall 27A is inserted into the support spring 81, the contact portion 84C of the second spring piece 84 passes between the insertion/extraction assist protrusions 28B, 28B.

Next, with reference to FIGS. 1A, 1B, 1C, 9A to 12B, actions to shift the electrical connector 1 of the present embodiment from the unmating position to the mating position will be described. These actions are performed when the fuse member 40 is attached to the electrical circuit.

FIGS. 9A, 9B, 10A, 10B show a change in the engaging state of the fuse busbar 42 and the clip spring 80A from the unmating position to the mating position in perspective views. FIGS. 11A, 11B, 12A, 12B are side views corresponding to FIGS. 9A, 9B, 10A, 10B. FIGS. 9A-12B show the engaging state of the clip spring 80A, which is similar to the engaging state of the clip spring 80B. Therefore, in the following description, the engaging state of the clip spring 80A will be described, and the redundant description of the engaging state of the clip spring 80B will be omitted.

In the unmating position, as shown in FIG. 1A, the lever assembly 10 and the cap assembly 60 are assembled together in the pre-mating state. At this time, the lever 50 is raised along the height direction Z. The cam protrusion 73 in the unmating position is located at one end of the cam groove 55.

Inside the lever assembly 10, the fuse member 40 is retained in the outer housing 20. At this time, the fusible body 41 is inserted into the slits 26C of the first partition walls 26A, 26B. In addition, the fuse busbars 42, 42 are each positioned such that the first contact portions 42A and the second contact portions 42B abut on the cutout portions 27C of the second partition walls 27A, 27B.

Figure 9A:
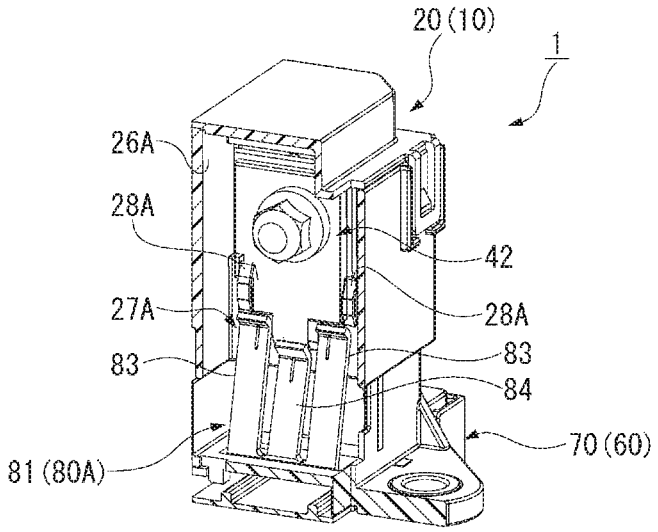
FIG. 9A is a sectional perspective view of a fuse busbar and the clip spring in the unmating position.
Figure 11A:
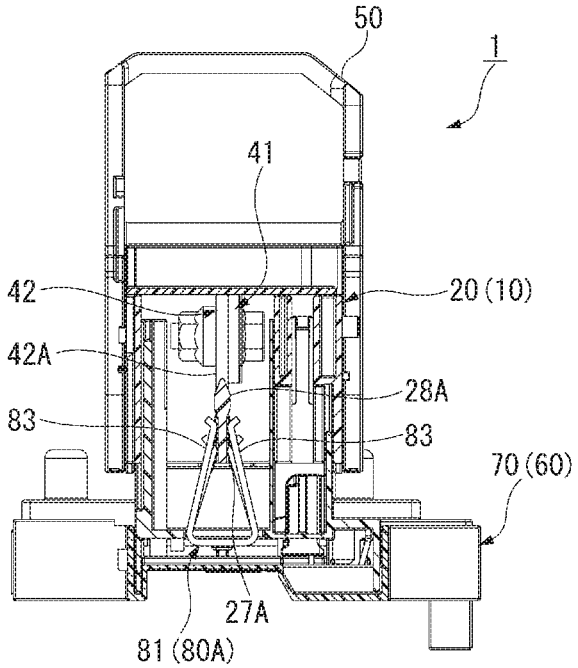
FIG. 11A is a sectional side view of the fuse busbar and the clip spring in the unmating position.

In the unmating position, as shown in FIGS. 9A and 11A, the second partition wall 27A is inserted in the support spring 81 of the clip spring 80A. At this time, the insertion/extraction assist protrusion 28A is located in a higher position in FIGS. 9A and 11A than the first spring piece 83. Though the insertion/extraction assist protrusion 28B is not shown in FIGS. 9A and 11A, a positional relationship between the insertion/extraction assist protrusion 28B and the second spring piece 84 is similar to a positional relationship between the insertion/extraction assist protrusion 28A and the first spring piece 83.

Thus, in the unmating position, the insertion/extraction assist protrusions 28A, 28B of the second partition walls 27A, 27B are positioned nearer to the frontage (opening 24) of the outer housing 20 than the fuse busbars 42, 42. In addition, the insertion/extraction assist protrusions 28A, 28B are not in contact with the first spring pieces 83 and the second spring piece 84.

When the lever 50 is turned from the unmating position, the cam protrusion 73 moving in the cam groove 55 converts the turning motion into a downward linear motion of the lever assembly 10. This causes the lever assembly 10 and the cap assembly 60 to approach each other in the height direction Z which is the mating direction.

Then, once the lever 50 is turned from the unmating position to the horizontal orientation, the electrical connector 1 shifts to the mating position shown in FIG. 1B. It should be noted that the cam protrusion 73 in the mating position is located in the middle of the cam groove 55.

The above turn of the lever 50 changes the engaging state of the fuse busbar 42 and the clip spring 80A from the state in the unmating position shown in FIGS. 9A and 11A in the following manner.

Figure 9B:
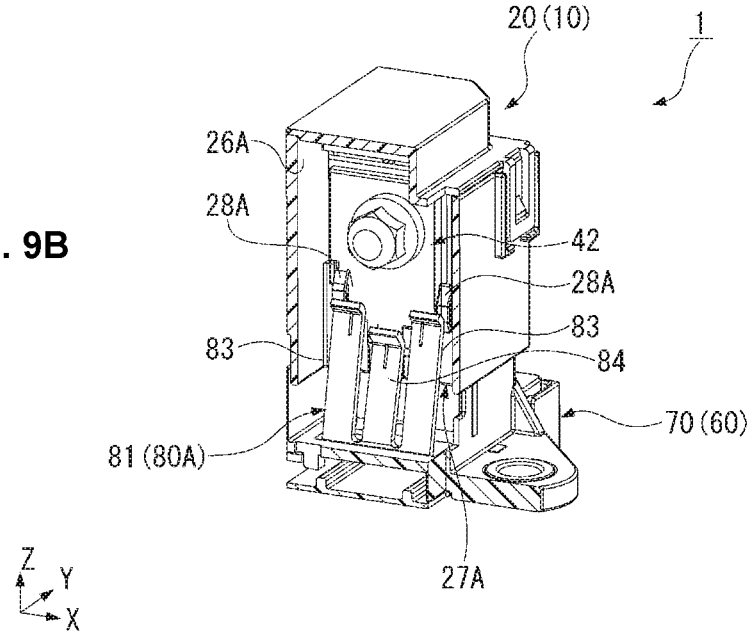
FIG. 9B is a sectional perspective view of the fuse busbar and the clip spring with the lever assembly shifted in a mating direction.
Figure 11B:
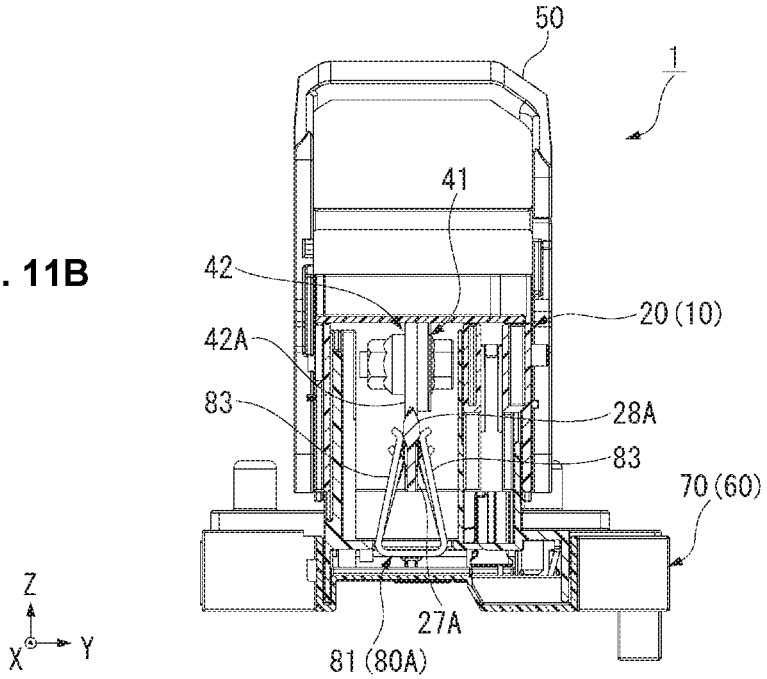
FIG. 11B is a sectional side view of the fuse busbar and the clip spring with the lever assembly shifted in the mating direction.

First, when the lever 50 is turned from the unmating position, a change from the state shown in FIGS. 9A and 11A to the state shown in FIGS. 9B and 11B occurs.

In FIGS. 9B and 11B, the outer housing 20 moves downward in FIGS. 9B and 11B with respect to the cap housing 70, and the second partition wall 27A is inserted deeper into the support spring 81 than it is in the unmating position. In this process, the two pairs of first spring pieces 83, 83 of the support spring 81 positioned in the lengthwise direction X come into contact with the insertion/extraction assist protrusions 28A, 28A, respectively. As the outer housing 20 moves downward in FIGS. 9B and 11B, the insertion/extraction assist protrusion 28A is inserted between the first spring pieces 83 facing each other in the width direction Y to cause elastic deformation of the first spring pieces 83. In this manner, a gap between the first spring pieces 83 facing each other in the width direction Y is expanded by the insertion/extraction assist protrusion 28A.

The position of the insertion/extraction assist protrusion 28A and the position of the contact portion 83C of the first spring piece 83 are offset from each other in the lengthwise direction X. Therefore, a relative movement of the second partition wall 27A to the support spring 81 in the height direction Z does not cause interference of the contact portion 83C with the insertion/extraction assist protrusion 28A.

Though the insertion/extraction assist protrusion 28B is not shown in FIGS. 9B and 11B, a positional relationship between the insertion/extraction assist protrusion 28B and the second spring piece 84 is similar to a positional relationship between the insertion/extraction assist protrusion 28A and the first spring piece 83. That is, once the second partition wall 27A is inserted deeper into the support spring 81 than it is in the unmating position, the pair of second spring pieces 84 contacts with the insertion/extraction assist protrusions 28B, 28B. As the outer housing 20 moves downward in FIGS. 9B and 11B, the insertion/extraction assist protrusions 28B, 28B are inserted into the second spring pieces 84 facing each other in the width direction Y to cause elastic deformation of the second spring pieces 84. In this manner, a gap between the second spring pieces 84 facing each other in the width direction Y is expanded by the insertion/extraction assist protrusions 28B, 28B.

The position of the insertion/extraction assist protrusion 28B and the position of the contact portion 84C of the second spring piece 84 are offset from each other in the length direction X. Therefore, a relative movement of the second partition wall 27A to the support spring 81 in the height direction Z does not cause interference of the contact portion 84C with the insertion/extraction assist protrusion 28B.

The second spring piece 84 is shorter in the height direction Z than the tall first spring piece 83, and is thus more difficult to deform elastically. Therefore, the first spring piece 83 is supported by one insertion/extraction assist protrusion 28A, whereas the second spring piece 84 is supported by two insertion/extraction assist protrusions 28B, 28B on both sides. This facilitates deformation of the second spring piece 84, so that the second spring piece 84 can be deformed sufficiently with force required to deform the first spring piece 83.

Figure 10A:
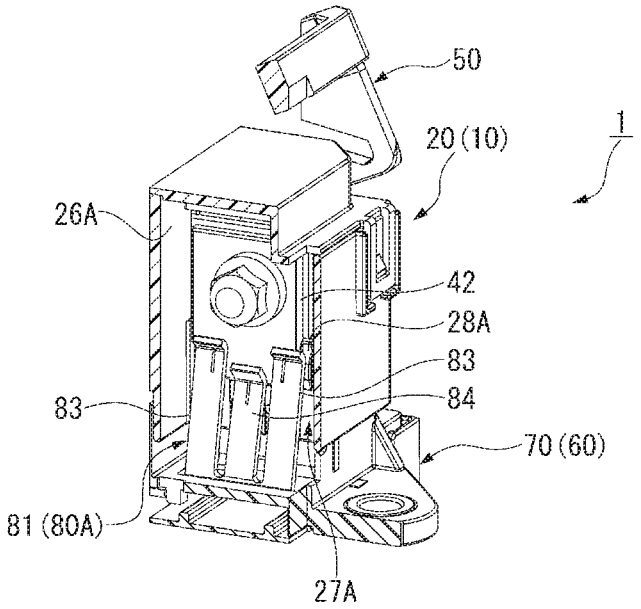
FIG. 10A is a sectional perspective view of the lever assembly shifted in the mating direction from FIG. 9B.
Figure 12A:
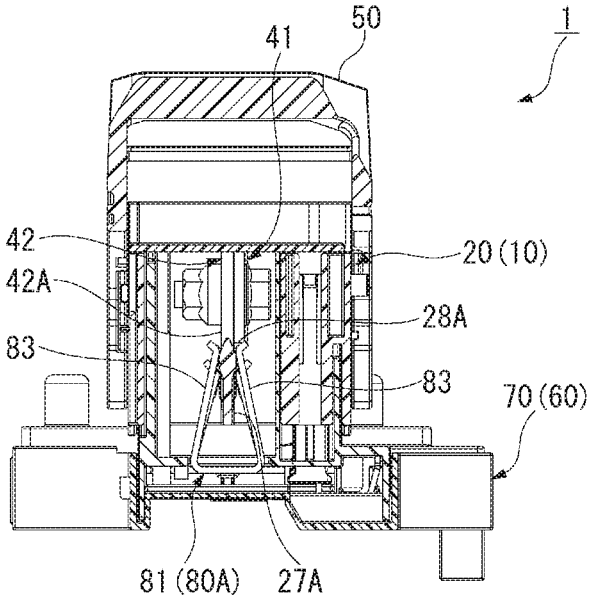
FIG. 12A is a sectional side view of the lever assembly shifted in the mating direction from FIG. 11B.

As the lever 50 is turned further from the state shown in FIGS. 9B and 11B, a change into the state shown in FIGS. 10A and 12A occurs.

In FIGS. 10A and 12A, the second partition wall 27A is inserted deeper in the support spring 81 than it is in the state shown in FIGS. 9B and 11B. This causes the first spring piece 83 excluding the contact portion 83C to slide on the insertion/extraction assist protrusion 28A, and the bent portion 83B of the first spring piece 83 climbs over the insertion/extraction assist protrusion 28A. Once the bent portion 83B climbs over the insertion/extraction assist protrusion 28A, the first spring piece 83 closes. Thereupon, the contact portion 83C of the first spring piece 83 protruding inward makes contact with the first contact portion 42A of the fuse busbar 42.

Though the insertion/extraction assist protrusion 28B is not shown in FIGS. 10A and 12A, a positional relationship between the insertion/extraction assist protrusion 28B and the second spring piece 84 is similar to a positional relationship between the insertion/extraction assist protrusion 28A and the first spring piece 83. That is, as the second partition wall 27A is inserted further into the support spring 81, the second spring piece 84 excluding the contact portion 84C slides on the insertion/extraction assist protrusion 28B, and the bent portion 84B of the second spring piece 84 climbs over the insertion/extraction assist protrusion 28B. Once the bent portion 84B climbs over the insertion/extraction assist protrusion 28B, the second spring piece 84 closes. Thereupon, the contact portion 84C of the second spring piece 84 protruding inward makes contact with the second contact portion 42B of the fuse busbar 42.

Figure 10B:
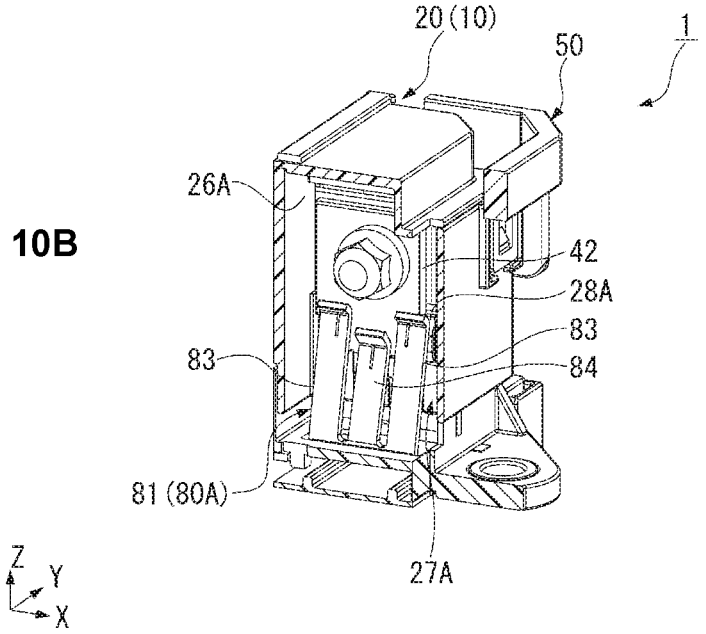
FIG. 10B is a sectional perspective view of the fuse busbar and the clip spring in the mating position.
Figure 12B:
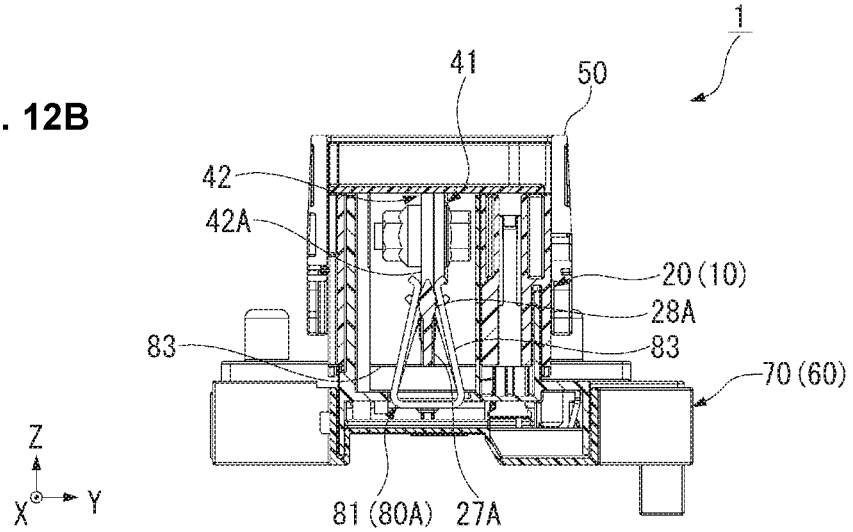
FIG. 12B is a sectional side view of the fuse busbar and the clip spring in the mating position.

Then, when the lever 50 is turned further from the state shown in FIGS. 10A and 12A, the engaging state reaches a state in the mating position shown in FIGS. 10B and 12B.

In FIGS. 10B and 12B, the second partition wall 27A is inserted yet deeper into the support spring 81 than it is in the state shown in FIGS. 10A and 12A. This causes the first contact portion 42A and the contact portion 83C of the first spring piece 83 to slide in the mating direction. Thereupon, a wiping action for wiping off an insulating substance on a contact surface that may adhere to the first contact portion 42A is performed. The insulating substance may be, for example, an oxide film on a terminal or dust.

Though the insertion/extraction assist protrusion 28B is not shown in FIGS. 10B and 12B, a positional relationship between the insertion/extraction assist protrusion 28B and the second spring piece 84 is similar to a positional relationship between the insertion/extraction assist protrusion 28A and the first spring piece 83. That is, as the second partition wall 27A is inserted further into the support spring 81, the second contact portion 42B and the contact portion 84C of the second spring piece 84 slide in the mating direction. Thereupon, a wiping action for wiping off the insulating substance on a contact surface that may adhere to the second contact portion 42B is performed.

In this manner, the first contact portion 42A of the fuse busbar 42 makes contact with the contact portion 83C of the first spring piece 83, and the second contact portion 42B of the fuse busbar 42 makes contact with the contact portion 84C of the second spring piece 84. In the mating position, with the insulating substance wiped off from the contact surface of the fuse busbar 42, electrical contact between the fuse member 40 and the clip spring 80A is established.

In the mating position, as shown in FIG. 12B, a position in which the first spring piece 83 supports the fuse busbar 42 and a position in which the second spring piece 84 supports the fuse busbar 42 are different in the height direction Z. Thereby, the fuse busbar 42 is supported by the support spring 81 at a plurality of points in the height direction Z, so that the fuse member 40 in the mating position is resistive against vibration in the width direction Y and thus easily stabilized.

When the lever 50 is slid horizontally from this state in the mating position, a change into the circuit actuation position shown in FIG. 1C occurs. The cam protrusion 73 in the circuit actuation position is located at the other end of the cam groove 55. In the circuit actuation position, the engaging state of the fuse busbar 42 and the support spring 81 does not change, but the electrical circuit including the fuse member 40 and the clip springs 80A, 80B is energized.

It should be noted that, when the fuse member 40 is removed from the electrical connector 1, it is only necessary to perform the above actions from the unmating position to the mating position reversely. The description of the actions in this case will be omitted.

In the present embodiment, when the lever assembly 10 and the cap assembly 60 are mated, the second partition walls 27A, 27B are inserted into the support spring 81 ahead of the fuse busbar 42. The insertion/extraction assist protrusions 28A, 28B are provided on both faces of the second partition walls 27A, 27B.

The positions of the insertion/extraction assist protrusions 28A, 28B are both offset from the positions of the contact portions 83C, 84C in the lengthwise direction X. The first spring piece 83 and the second spring piece 84 of the support spring 81 excluding the contact portions 83C, 84C contact with the insertion/extraction assist protrusions 28A, 28B. This contact causes elastic deformation to expand the gap in the width direction Y in the support spring 81.

Once the first spring piece 83 and the second spring piece 84 climb over the insertion/extraction assist protrusion 28A, 28B, the first spring piece 83 and the second spring piece 84 close. Thereafter, as the lever assembly 10 moves in the mating direction with respect to the cap assembly 60, the contact portion 83C, 84C slide on the surface of the fuse busbar 42.

The insertion/extraction assist protrusions 28A, 28B are each arranged in positions offset nearer to a mating start point than the positions of the contact portions 83C, 84C during mating. During mating, after the first spring piece 83 and the second spring piece 84 climbs over the insertion/extraction assist protrusions 28A, 28B located nearer to the start point than the contact portions 83C, 84C during mating, the fuse busbar 42 and the contact portions 83C, 84C slide (FIG. 10B, FIG. 12B). As compared with the configuration where the fuse busbar 42 and the contact portions 83C, 84C slide on each other from near the mating start point, according to the present embodiment, a section in which the fuse busbar 42 and the contact portions 83C, 84C slide is shorter.

As the section in which the fuse busbar 42 and the contact portions 83C, 84C slide becomes shorter, the risk of a damage to plating applied to the surface of the fuse busbar 42 due to sliding on the contact portions 83C, 84C is also reduced. As described above, according to the present embodiment, abrasion due to the contact between the fuse busbar 42 and the contact portions 83C, 84C during mating can be reduced. With the reduction of abrasion of the fuse busbar 42, the durable number of times of insertion/extraction of the fuse busbar 42 and the support spring 81 increases. This reduces the frequency of replacement of parts of the electrical connector 1, and thus also reduces the operational cost of the electrical connector 1.

In the present embodiment, after the support spring 81 climbs over the insertion/extraction assist protrusions 28A, 28B, the contact portions 83C, 84C slide on the surface of the fuse busbar 42. Thereby, the wiping action for wiping off the insulating substance from the surface of the fuse busbar 42 is performed in a minimal range excluding the section in which the support spring 81 on the insertion/extraction assist protrusions 28A, 28B slide. According to the present embodiment, where the contact makes contact with the mating terminal without sliding thereon, the risk of a contact failure due to the insulating substance between the fuse busbar 42 and the support spring 81 is reduced.

The present invention is not limited to the configuration where the insertion/extraction assist protrusions 28A, 28B are provided in the outer housing 20. For example, the insertion/extraction assist protrusion may be provided in the support spring. Furthermore, in the mating terminal that receives the support spring, a recessed portion for receiving the insertion/extraction assist protrusion may be provided in front of the position of the contact portion during mating. The configuration of this variation can also achieve advantageous effects similar to the above embodiment. In the case of this variation, the insertion/extraction assist protrusion may be integrally formed with the support spring by forming or pressing the support spring. Alternatively, a insertion/extraction assist protrusion component may be fixed later to the support spring with an adhesive or the like.

The electrical connector of the present invention is not limited to the configuration where two housings are mated through the operation of the lever 50. For example, the present invention may be applied to an electrical connector where one housing is directly inserted into the other housing and connected thereto.

In addition, in the present invention, the shape of the support spring 81 and/or the arrangement of the insertion/extraction assist protrusions 28A, 28B is not limited to the configuration of the above embodiment. For example, the support spring 81 may be provided with only a pair of support pieces. Alternatively, the support spring 81 may be provided with two pairs or four more pairs of support pieces. In addition, when the support spring 81 is provided with a plurality of pairs of support pieces, the respective heights of the support pieces may be aligned in the height direction Y.

The second spring piece 84 of the support spring 81 may be supported by one insertion/extraction assist protrusion 28B. In an embodiment, a width in the X direction of the insertion/extraction assist protrusion 28B for supporting the second spring piece 84 is wider than a width in the X direction of the insertion/extraction assist protrusion 28A for supporting the first spring piece 83. If the width in the X direction of the insertion/extraction assist protrusion 28B is wider than that of the insertion/extraction assist protrusion 28A, the second spring piece 84 that is shorter in the height direction Z than the tall first spring piece 83 more easily deforms. Therefore, as is the case with two insertion/extraction assist protrusions 28B supporting the second spring piece 84, the second spring piece 84 can be sufficiently deformed with force required to deform the first spring piece 83.

What is claimed is:

1. An electrical connector, comprising:

a first housing;

a mating terminal retained in the first housing;

a second housing mated with the first housing;

a contact member disposed in the second housing, the contact member being electrically connected with the mating terminal by pinching the mating terminal with a plurality of spring pieces facing each other, the spring pieces each have a contact portion protruding inward; and an insertion/extraction assist protrusion adapted to expand a gap between the spring pieces when the first housing and the second housing move relative to one another in a mating direction in which the first housing and the second housing are mated, the insertion/extraction assist protrusion is arranged offset from the contact portions in a plane crossing the mating direction and is arranged nearer to a start point of the mating than the contact portions during the mating in the mating direction.

2. The electrical connector of claim 1, wherein the insertion/extraction assist protrusion expands the gap between the spring pieces as the first housing and the second housing approach.

3. The electrical connector of claim 2, wherein the contact portions slide on the mating terminal after the gap between the spring pieces is expanded during mating.

4. The electrical connector of claim 1, wherein the insertion/extraction assist protrusion is integrally formed with the first housing.

5. The electrical connector of claim 4, wherein the insertion/extraction assist protrusion is inserted between the spring pieces as the first housing and the second housing approach.

6. The electrical connector of claim 5, wherein the first housing extends along the mating direction and has a partition wall positioned nearer to an opening side of the first housing than the mating terminal in the mating direction.

7. The electrical connector of claim 6, wherein the insertion/extraction assist protrusion is formed on a pair of faces of the partition wall.

8. The electrical connector of claim 1, wherein the contact member has a plurality of pairs of the spring pieces.

9. The electrical connector of claim 8, wherein the insertion/extraction assist protrusion has a plurality of protrusions corresponding to each of the plurality of pairs of the spring pieces.

10. The electrical connector of claim 9, wherein the contact member has a pair of first spring pieces and a pair of second spring pieces, each of the second spring pieces having a shorter length in the mating direction than the first spring pieces.

11. The electrical connector of claim 10, wherein the first spring pieces and the second spring pieces support the mating terminal in different positions in the mating direction.

12. The electrical connector of claim 11, wherein the second spring pieces make contact with a larger number of the insertion/extraction assist protrusions than the first spring pieces.

* * * * *